US009574403B2

(12) United States Patent
Ferrari

(10) Patent No.: US 9,574,403 B2
(45) Date of Patent: Feb. 21, 2017

(54) MOBILE DRILLING RIG

(71) Applicant: DRILLMEC S.p.A., Gariga di Podenzano (PC) (IT)

(72) Inventor: Stefano Ferrari, Barbiano (IT)

(73) Assignee: DRILLMEC SPA, Gariga di Podenzano (PC) (IT)

( * ) Notice: Subject to any disclaimer, the term of this patent is extended or adjusted under 35 U.S.C. 154(b) by 0 days.

(21) Appl. No.: 14/433,307

(22) PCT Filed: Oct. 3, 2013

(86) PCT No.: PCT/IB2013/059087

§ 371 (c)(1),
(2) Date: Apr. 2, 2015

(87) PCT Pub. No.: WO2014/054015

PCT Pub. Date: Apr. 10, 2014

(65) Prior Publication Data

US 2015/0240562 A1 Aug. 27, 2015

(30) Foreign Application Priority Data

Oct. 4, 2012 (IT) ..... TO2012A0863

(51) Int. Cl.
*E21B 7/02* (2006.01)
*E21B 15/00* (2006.01)

(52) U.S. Cl.
CPC ..... *E21B 7/023* (2013.01); *E21B 15/00* (2013.01)

(58) Field of Classification Search
CPC ..... E21B 7/023; E21B 15/00
(Continued)

(56) References Cited

U.S. PATENT DOCUMENTS 2,510,151 A * 6/1950 Stewart, Jr. ..... B66B 1/12 187/282
2,993,570 A * 7/1961 Bender ..... E04H 12/34 52/118

(Continued)

FOREIGN PATENT DOCUMENTS

DE 44 36 264 11/1995
EP 0 548 900 12/1992

(Continued)

OTHER PUBLICATIONS

International Search Report for International Application No. PCT/IB2013/059087 mailed Jan. 22, 2014 (3 pages).

*Primary Examiner* — Joshua J Michener
*Assistant Examiner* — Keith Minter
(74) *Attorney, Agent, or Firm* — Merchant & Gould P.C.

(57) ABSTRACT

A mobile drilling rig (1) includes a mast (3), a drilling head (5) for sliding in use along the mast (3), and at least one hoist (4). The drilling head (5) is supported by at least two hoisting wire cables (24). The mast (3) is telescopic and includes a main load carrying member (31), for extending the telescopic mast (3), at whose end a plurality of pulleys (26) are provided, on which the hoisting wire cables (24) slide. The main load carrying member (31) is adapted to bring the mast (3) from a closed operating configuration to an extended operating configuration and vice versa. The movement of the drilling head (5), when the mast (3) is in the extended operating configuration, takes place by the hoisting wire cables (24), which are pulled and released by the at least one hoist (4).

7 Claims, 6 Drawing Sheets

(58) Field of Classification Search
USPC ..... 52/118
See application file for complete search history.

(56) References Cited

U.S. PATENT DOCUMENTS

| | | | | |
|---|---|---|---|---|
| 3,145,786 | A * | 8/1964 | O'Neill | E21B 19/15 173/28 |
| 3,201,091 | A * | 8/1965 | Woolslayer | E21B 7/02 254/399 |
| 3,256,660 | A * | 6/1966 | McMakin | 52/299 |
| 3,633,767 | A * | 1/1972 | Mitchell | E21B 19/14 414/22.68 |
| 4,394,914 | A * | 7/1983 | Privat | B66C 23/702 212/203 |
| 4,434,902 | A * | 3/1984 | Goode | B66C 23/705 212/349 |
| 4,866,893 | A * | 9/1989 | McGinnis | H01Q 1/1235 52/108 |
| 4,932,175 | A * | 6/1990 | Donnally | E21B 15/00 52/118 |
| 7,584,810 | B1 * | 9/2009 | McKnight et al. | 175/162 |
| 8,893,825 | B1 * | 11/2014 | Akerman | 175/113 |
| 9,010,410 | B2 * | 4/2015 | Story | 166/77.52 |
| 2005/0194189 | A1 * | 9/2005 | Barnes | E21B 7/02 175/122 |
| 2007/0074460 | A1 | 4/2007 | Belik | |
| 2009/0084558 | A1 | 4/2009 | Bloom | |
| 2009/0139731 | A1 | 6/2009 | Rieder et al. | |
| 2009/0314547 | A1 | 12/2009 | Stoetzer et al. | |
| 2009/0320385 | A1 * | 12/2009 | Stoetzer | E02D 7/00 52/118 |
| 2013/0112395 | A1 * | 5/2013 | Story | 166/77.52 |
| 2013/0269268 | A1 * | 10/2013 | Thiessen | E21B 15/00 52/118 |
| 2013/0340356 | A1 * | 12/2013 | Flusche | 52/116 |
| 2013/0343838 | A1 * | 12/2013 | Flusche | 414/22.62 |
| 2014/0262520 | A1 * | 9/2014 | Petrello et al. | 175/57 |
| 2015/0136422 | A1 * | 5/2015 | Rodgers | 166/379 |
| 2015/0143759 | A1 * | 5/2015 | Sparkman et al. | 52/123.1 |

FOREIGN PATENT DOCUMENTS

| | | |
|---|---|---|
| EP | 1 884 619 | 2/2008 |
| WO | WO 2010/046757 | 4/2010 |

* cited by examiner

MOBILE DRILLING RIG

This application is a National Stage Application of PCT/IB2013/059087, filed 3 Oct. 2013, which claims benefit of Serial No. TO2012A000863, filed 4 Oct. 2012 in Italy and which applications are incorporated herein by reference. To the extent appropriate, a claim of priority is made to each of the above disclosed applications.

BACKGROUND

The present invention is relative to drilling rigs and, in particular, it is relative to a mobile drilling rig of the electric-hydraulic type comprising a telescopic mast and a mobile drill pipe storing and handling system.

In particular, the drilling rig according to the present invention can be associated with a vehicle for the transportation of the drilling rig itself.

Drilling rigs are known, which are associated with a vehicle for the transportation of the drilling rig itself.

These vehicles can be trucks, trailers or semi-trailers.

Said drilling rigs comprise a mast and a carriage that slides on the mast, along suitable guides, and supports the drilling head.

During the transportation, said mast is closed and arranged horizontally on said transportation vehicle.

Said mast is raised, in the working configuration, which is arranged vertically relative to the ground, by means of hydraulic pistons and mechanical systems that are known to a skilled person.

The technical features required for the drilling, in order to reduce the trip-in time and the trip-out time of a drilling system, lead the constructors of said drilling rigs to manufacture drilling rigs that allow users to use a drill string that is as long as possible. Normally, this technical feature forces constructors to manufacture drilling rigs with large dimensions.

This manufacturing feature generates a technical problem concerning the transportation of a structure with remarkable dimensions, both in terms of weight and size and in terms of ability to actually maneuver the vehicle on which the mast and the other elements of the drilling rigs are arranged.

Furthermore, every single country has its own laws regulating the dimensions and the maximum weight of the vehicles for the transportation on wheels, thus causing the movement of the drilling rigs from one drilling area to the other to become even more difficult.

The European patent no. EP0548900 describes a mobile drilling rig comprising a telescopic mast, which can be extended by means of a central hydraulic cylinder.

Another problem arising from the increase in the dimensions and the weigh of the drilling rig and, in particular, of the mast is relative to the forces acting upon the mast. As a matter of fact, structures with large dimensions produce an increase in the compression force acting upon the mast, which is transferred, through the drill floor, to the base section.

The structure of the mast, which is adapted to control the movements of the carriage comprising the drilling head, must be able to counter the torsion transmitted to the drill string by the drilling head itself.

Furthermore, the great length of the mast can cause a bending moment, which is generated by the lack of symmetry of the compression forces relative to the longitudinal axis of the mast.

In order to solve the latter problem and avoid damages to the structure of the mast, constructors increase the dimensions of the mast even more, so as to strengthen the structure of the mast itself. The greater sturdiness of the mast, though, worsens the technical problem concerning the increase in the mass of the drilling rig.

The increase in the overall mass and dimensions of the drilling rig leads to an increase in the costs for the installation and the removal of the drilling rig itself.

Furthermore, as already mentioned above, the increase in the mass of the drilling rig and, in particular, of the mast causes an increase in the compression force, thus forcing manufacturers to also strengthen the drill floor and the base section in order to correctly unload said compression force.

Designing technical features are aimed at providing a main load carrying member that is contained in the structure or skeleton of the mast, but is distinct from the mast. Furthermore, designing technical features require the loads acting upon said element to be perfectly symmetrical, so that the compression is entirely unloaded onto said element and the mast is not subject to the bending moments.

In the state of the art these objects cannot be reached, since the continuous movement of the drilling head, performed by lengthening and shortening the length of the mast itself, causes bending moments to the structure of the mast. These bending moments are normally countered by strengthening the structure and, hence, by increasing the weight of the drilling rig with the problems mentioned above.

In the prior art, as described for example in patent EP 0548900B1, the drilling head is caused to move up and down by hydraulic devices, such as hydraulic cylinders and hydraulic motors. The use of a hydraulic raising system reduces the energetic efficiency of the drilling rig. As a matter of fact, in order to actuate the hydraulic devices, the electric motors must actuate hydraulic pumps, with a first transformation from electric energy into fluidic energy. These pumps feed hydraulic devices, such as hydraulic cylinders or motors, thus performing a second transformation from fluidic energy into mechanical energy, with the consequent reduction of the efficiency of the system.

SUMMARY

The object of the present invention is to solve the problems mentioned above by providing a drilling rig in which the compression forces are all symmetrical relative to the structure of the mast, in particular relative to the longitudinal axis, and in which there is the maximum energetic efficiency for the movements of the drilling head along said mast.

In particular, the object of the present invention is to provide a mobile drilling rig, which can be easily transported and, in the use operating configuration, allows users to use drill strings with different drill pipes connected to one another, for example two or three drill pipes, reducing at the same time the energy consumption and the weight of the entire drilling rig.

BRIEF DESCRIPTION OF THE DRAWINGS

The features and advantages of the drilling rig will be best understood upon perusal of the following detailed description of a preferred embodiment with reference to the accompanying drawings, which respectively show what follows:

FIG. 1A shows the drilling rig in the working operating configuration, while FIG. 1B shows the drilling rig in the transportation operating configuration;

FIG. 2A shows the embodiment with four drums on which four hoisting wire ropes are wound, while FIG. 2B shows the embodiment with two drums on which two hoisting wire ropes are wound;

DETAILED DESCRIPTION

Figure 1A:
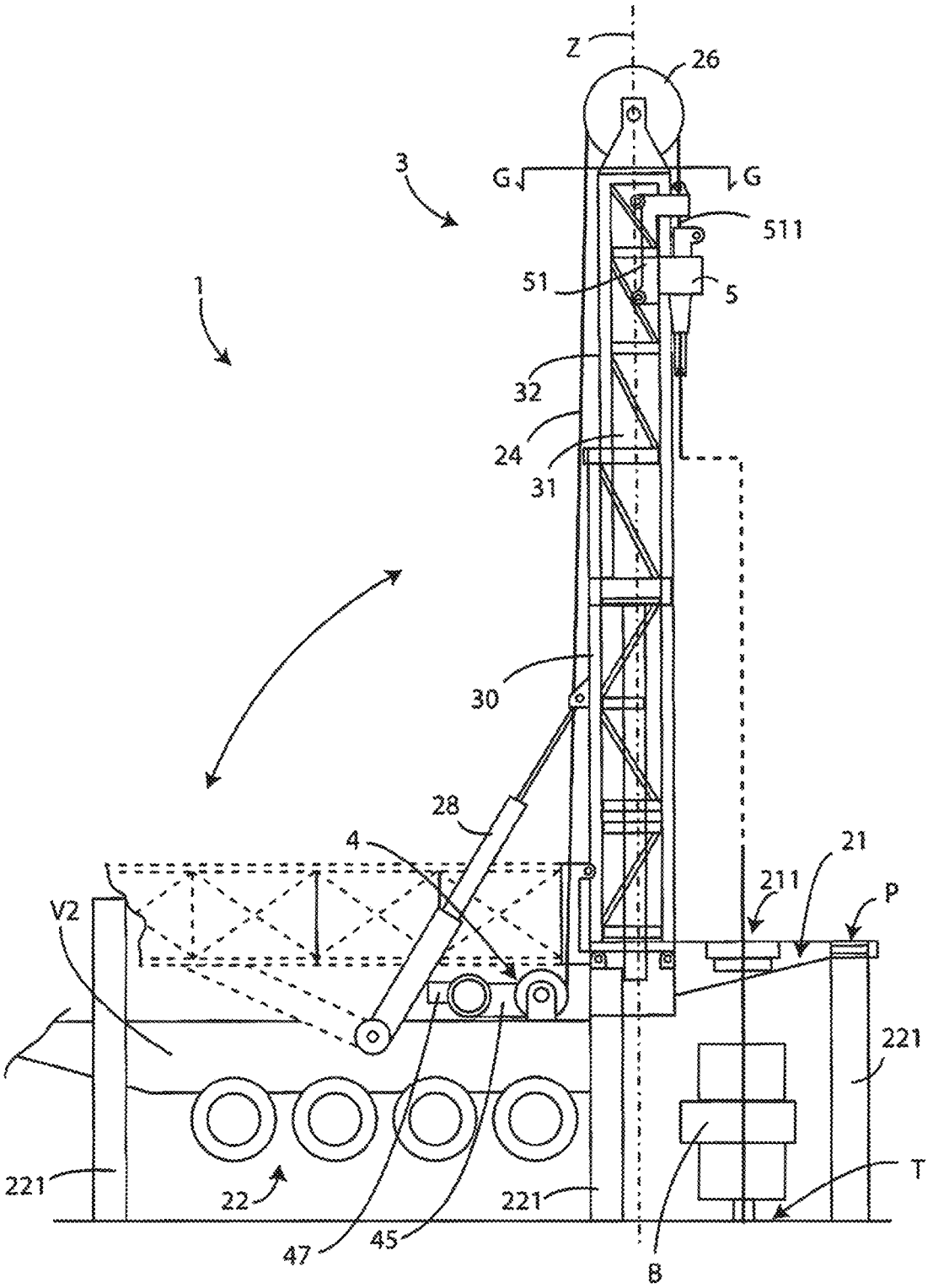
FIGS. 1A and 1B show, in lateral views, the mobile drilling rig in different operating configurations; in detail.

With reference to the above-mentioned figures, mobile drilling rig 1 comprises a mast 3, a drill floor 21, on which said mast 3 is fixed, a base section 22, on which the entire drilling rig weighs, and a drilling head 5, which, in use, is adapted to slide along said mast 3 supported by at least two hoisting wire ropes 24. Said hoisting wire ropes are preferably made of steel and their number is proportional to the maximum pull of the drilling rig, more preferably their number is a multiple of two, and at least a draw-works or hoist 4 being provided.

Said mast 3 preferably is of the telescopic type and comprises a main load carrying member 31, which is adapted to extend said telescopic mast.

A plurality of pulleys 26, on which said hoisting wire ropes 24 slide, are rigidly fixed to the end of said carrying member 31. The number of said pulleys 26 is at least equal to the number of hoisting wire ropes 24.

Said mast comprises a fixed portion 30, which is adapted to be fixed on drill floor 21 by means of front shoes 212 and back shoes 213, thorough suitable hinges, and a mobile portion 32, which is adapted to slide inside said fixed portion 30 and is moved by said main load carrying member 31.

Said main load carrying member 31 is adapted to bring said mast 3 from the closed operating configuration to the extended operating configuration and vice versa. Member 31 is connected to mobile portion 32, for example a telescopic one, and is adapted to transfer the compression load to said base section 22, hence not to the structure of mast 3, which comprises, in particular, said mobile portion 32 and said fixed portion 30.

This structural configuration allows users to maximize the symmetrical distribution of forces along the axis of mast 3, thus reducing the bending effects of the structure and, in particular, of mast 3 and of member 31.

For the purposes of the present invention, the expression "mast in the extended operating configuration" means that the mast is erect on drill floor 21 in its maximum longitudinal extension.

For the purposes of the present invention, the expression "mast in the closed operating configuration" means that the mast is not in its maximum longitudinal extension, preferably it is in its minimum longitudinal extension.

The movement of drilling head 5, when said mast 3 is in the extended operating configuration, takes place by means of said hoisting wire ropes 24, which are pulled and released by said at least one hoist 4.

Said at least one hoist 4 comprises at least two drums 43, preferably a plurality of drums 43, for example one drum 43 for each hoisting wire rope 24, and a single shaft 41, with a drive train 45, preferably a gear drive.

In a preferred embodiment, said hoist 4 is controlled electrically. In the embodiments shown in FIGS. 2A and 2B, said hoist 4 is moved by means of at least one electric motor 47, which is controlled by means of a suitable control unit 471.

Said control units 471, in turn, are preferably managed by and an automatic central control unit, not shown, which is adapted to automatically control drilling rig 1 according to the present invention.

The use of the gear drive permits a reduction of energy losses, thus increasing the efficiency of the drilling rig.

Furthermore, while said hoisting wire ropes 24 are being released by hoist 4, part of the electric energy generated by the rotation of the hoist itself can be recovered by means of said motors 47. This energy can be stored or used by other electronic devices comprised in drilling rig 1.

Thanks to the electric control, it is possible to directly control electric motors 47, which, in turn, directly actuate the drive train of hoist 4, thus directly turning the electric energy into mechanical energy. In particular, drums 43, which are coupled to shaft 41, are moved by means of gear drive 45.

Said hoist 4 comprises, furthermore, brakes 49, which preferably are service brakes or safety brakes.

Each pair of drums 43, which is associated with the same number of hoisting wire ropes 24, is controlled by a single electric motor 47, which transmits the motion to shaft 41 by means of said gear drive 45.

Figure 2B:
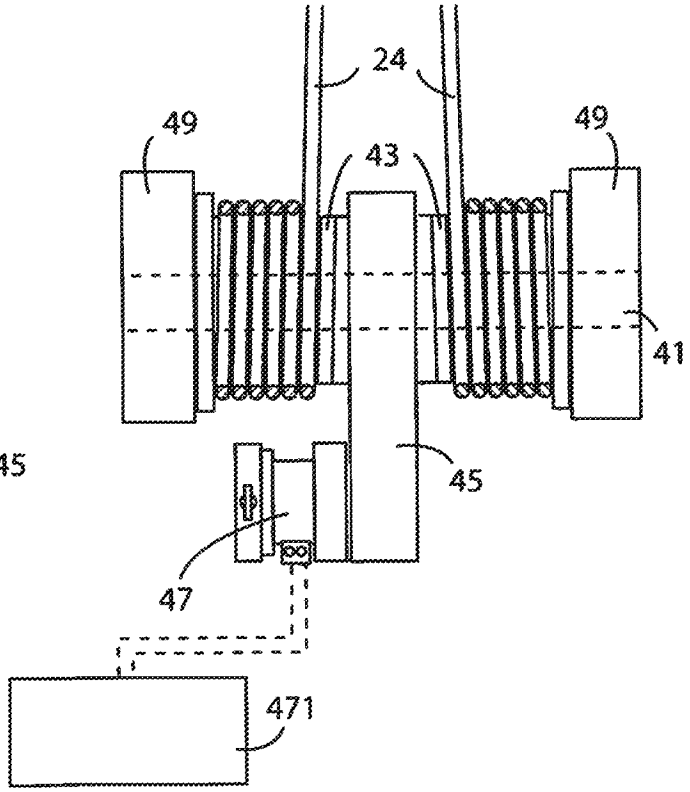
FIGS. 2A and 2B show different embodiments of the draw-works or hoist; in detail.
Figure 2A:
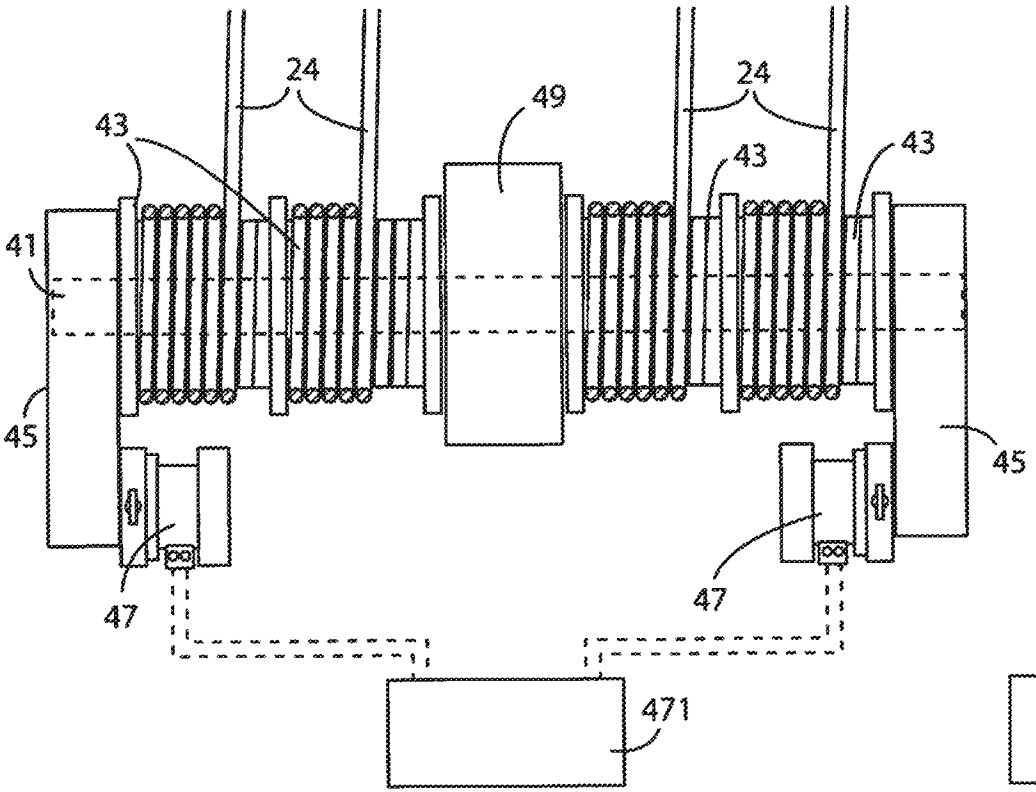

In the embodiment of FIG. 2A, hoist 4 according to the present invention comprises four drums 43, which are associated with four hoisting wire ropes 24, one for each drum. Said hoist 4 is controlled by two electric motors 47, which are arranged at the ends of single shaft 41, which is shared by all drums 43.

In the embodiment of FIG. 2B there are provided two hoisting wire ropes 24 and the same number of drums 43. This embodiment comprises one single electric motor 47 and gear drive 45 is arranged in the middle between the two drums 43. Gear drive 45 is directed at single shaft 41, which is shared by both drums 43.

Hoist 4 according to the present invention, besides high-power motors 47 for the movements, can comprise one or more auxiliary low-power motors, which are associated with the same number of reduction gears with a high reduction ratio, which are useful in the drilling step, where it requires a very low release speed, but a high pull of the rope. This solution allows the drilling rig to be used in three different modes: with a constant load, with a constant pull speed, and with a constant fluid pressure, in which the rotation speed of the drum and, hence, the downward speed of the drill string "W" is such as to keep the pressure of the fluid used to rotate the drill bit constant.

Said drilling head 5 comprises a carriage 51, adapted to slide along suitable guides 35 provided in mast 3, both on the fixed portion 30 and on the mobile portion 32, so as to be able to slide along the entire longitudinal extension of mast 3.

The actuation of drilling head 5, which is needed to cause the drill pipes to rotate, is preferably of the hydraulic type, for example by means of hydraulic motors. In the embodiment shown in FIG. 4 there are provided two hydraulic motors 55, so as to reduce the size and the weight of the components making up the drilling rig. The use of the hydraulic transmission to actuate drilling head 5 can be easily performed and it involves smaller problems both in terms of anti-explosion and in terms of operating temperature. The hydraulic transmission can be replaced by the electric transmission in those drilling rigs that require a high drilling power.

Figure 5:
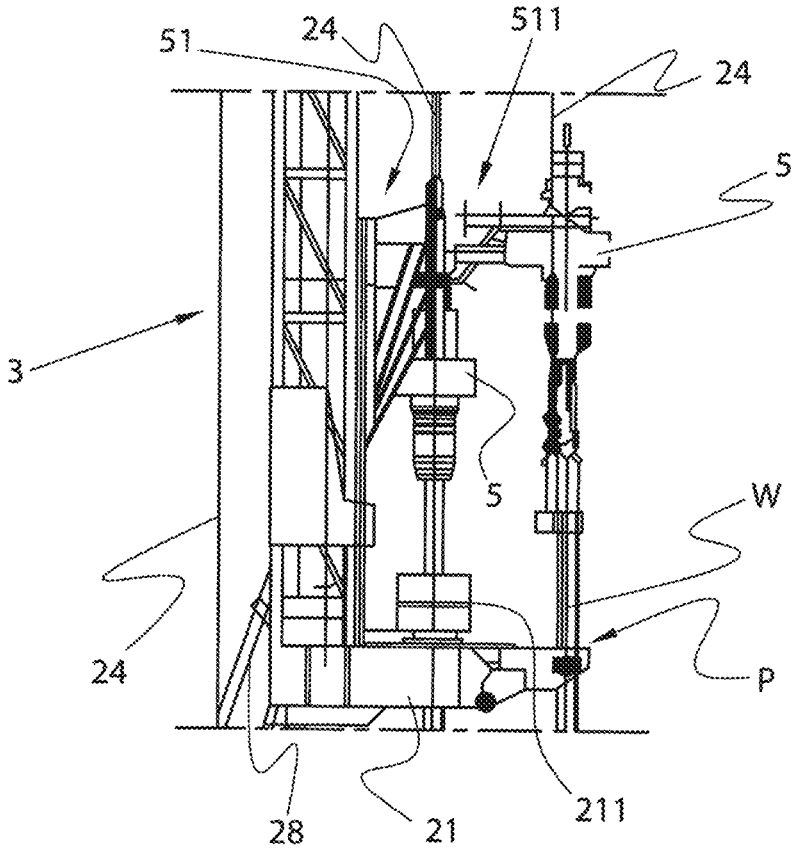
FIG. 5 shows a detail of the pantograph mechanism comprised in the carriage adapted to move the drilling head along the mast.

Said carriage 51 comprises a pantograph mechanism 511 to move said drilling head 5 along an axis that is substantially transverse to longitudinal axis "Z" of mast 3. A non-limiting embodiment of this pantograph mechanism is shown in FIG. 5.

Main load carrying member 31 is a hydraulic cylinder comprising a sleeve 311, which defines an oil containing chamber 310, and a piston 312, whose rod 313 is connected to a hydraulic feeding system 33.

Said sleeve 311 comprises, furthermore, a relief valve 315 and said piston comprises, furthermore, a gasket 314.

Figure 1B:
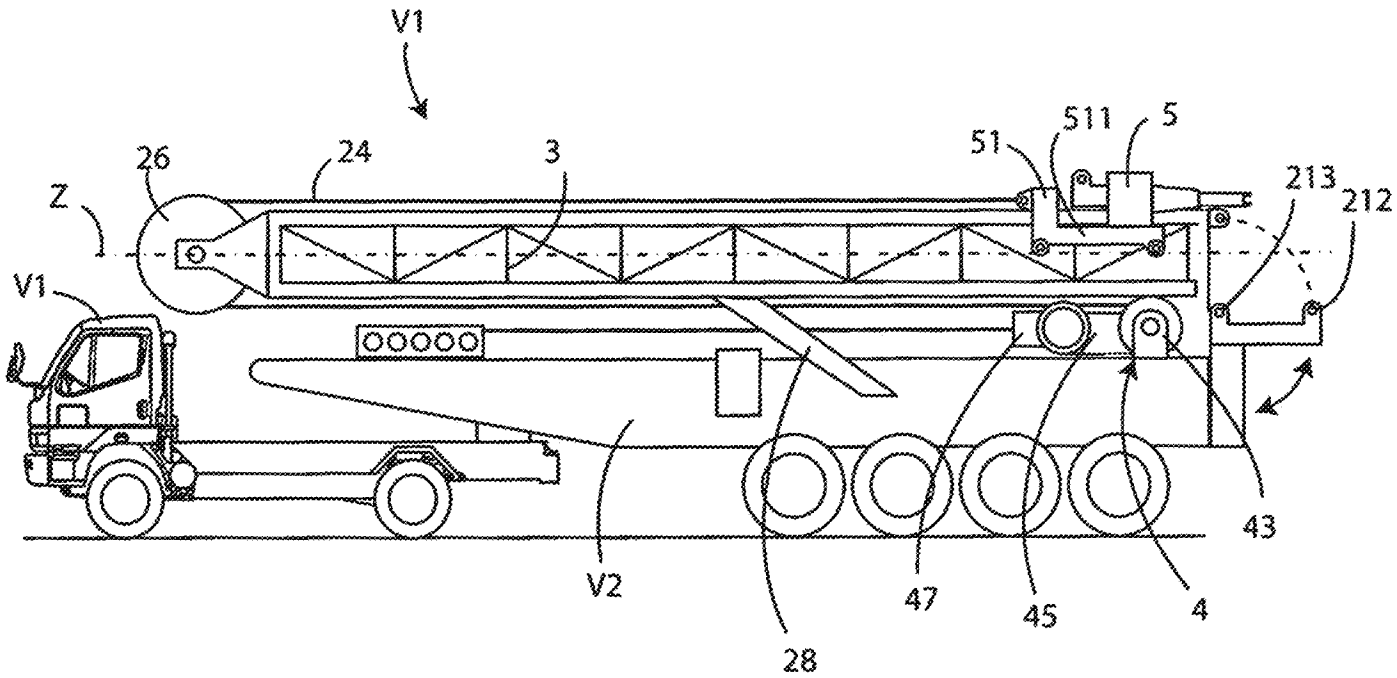
Figure 3:
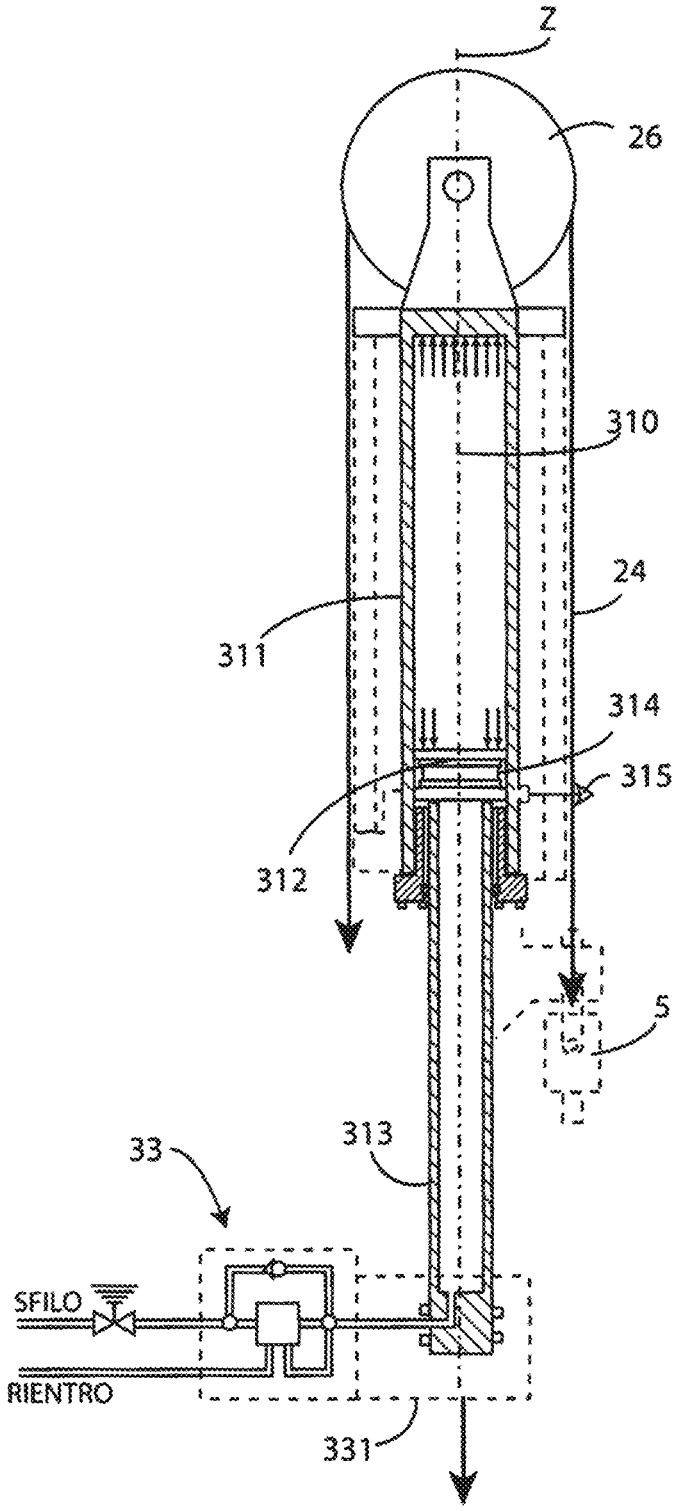
FIG. 3 shows, in a lateral section view, the main load carrying member and the hydraulic feeding system associated therewith.

Said sleeve 311 is constrained to mobile portion 32 of mast 3 and to pulleys 26 used to pull and release hoisting wire ropes 24, preferably at the upper end of sleeve 311 itself, as shown in FIGS. 1A, 1B and 3.

Hydraulic feeding system 33 comprises at least one circuit for the extraction of piston 312 and of rod 313, a re-introduction circuit to allow the piston to be re-introduced into chamber 310 of sleeve 311, and a hydraulic block 331 comprising overcenter taps and valves, not shown in detail, adapted to allow mast 3 to be kept in the extended configuration by means of the extension of main load carrying member 31, once the piston/rod 312/313 is completely extracted.

These circuits of hydraulic system 33 will not be described in detail, since they are known to a skilled person.

Said pulleys 26 permit the movement of said hoisting wire ropes 24, which, at one end, are fixed to said drilling head 5 and, at the opposite end, are wound on respective drum 43 of the hoist according to the present invention.

Main load carrying member 31 is adapted to bring mast 3 to the extended configuration. Said main load carrying member 31, unlike the drilling rigs of the prior art, is not used to move drilling head 5, which is moved by means of the hoisting wire ropes connected to hoist 4 according to the present invention.

Hoist 4 according to the present invention is fixed to a fixed sub-structure, for example base section 22 of drilling rig 1 according to the present invention.

Mast 3 moves from the closed configuration, taken on, for example, during the transportation of drilling rig 1, to the extended configuration by means of hydraulic system 33; simultaneously, piston 312 is extracted until the maximum longitudinal extension of mast 3 is reached. Subsequently, said main load carrying member 31 is locked in this position, until the drilling rig has to be disassembled to the moved to a new drilling site.

In order to raise the mast from the horizontal position taken on during the transportation, in which it preferably is in the closed configuration, to the vertical position on drill floor 21, which is taken on during the use of the drilling rig, two raising cylinders 28 are provided, which are fixed to two sides of fixed portion 30 of mast 3, as shown for example in FIG. 1A.

Said raising cylinders 28, by extending, allow the mast to rotate around the connection hinges arranged in correspondence to said back shoes 213. Once mast 3 is in the vertical position, mast 3 is also fixed to front shoes 212.

Base section 22 comprises a plurality of stabilizers 221 both for base section 22 itself and for drill floor 21, as shown in FIG. 1A.

In particular, base section 22 comprises front legs 221*a*, which are fixed to said drill floor 21 and adapted to support drill floor 21 itself. Said drill floor 21 must be able to support at least one drill pipe "W", which is arranged in a mouse hole "P".

Drill floor 21 comprises, if necessary, a rotary table 211 to contribute to the drilling.

Furthermore, the drilling rig according to the present invention comprises a blow out preventer or BOP preventer "B", which, in suitable instants of the drilling steps, is arranged above centre well "T".

In the preferred embodiment, pantograph mechanism 511 is an articulated quadrilateral comprising two rigid arms, which are fixed to carriage 51 and to the drilling head, at least two pistons, each one fixed to said carriage and to one of said arms. Said pistons, during their movement, are adapted to move drilling head 5 by means of a roto-translation movement, as shown for example in FIG. 5.

Figure 4:
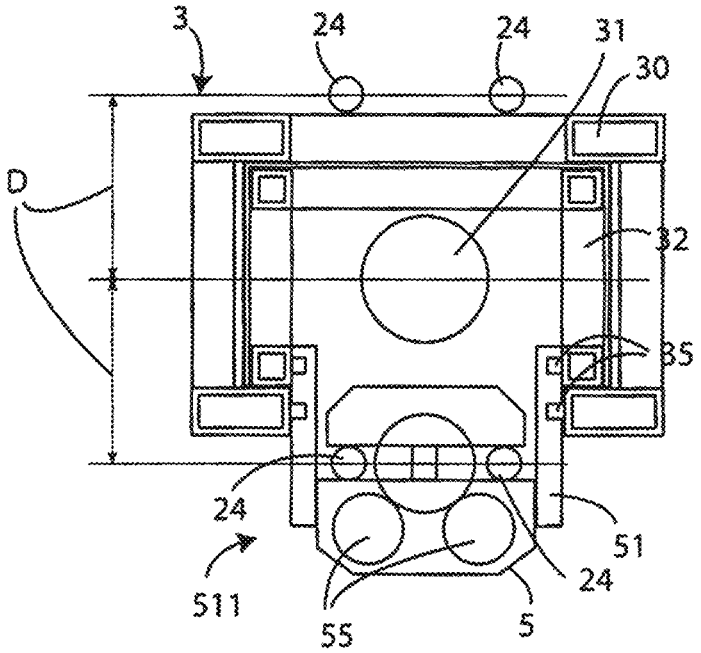
FIG. 4 shows, in a plan section view along line GG of FIG. 1A, the mast of the drilling rig according to the present invention.

With the combination of the structure of mast 3, and in particular of main load carrying member 31, and of the movement of drilling head 5 by means of hoisting wire ropes 24, which are pulled and released by means of a hoist 4, it is possible to eliminate the bending effects of member 31, since the forces acting upon the axis of member 31 are symmetrical relative to the axis of member 31 itself. Indeed, as shown in FIG. 4, the structure of mast 3 is symmetrical relative to main load carrying member 31. In particular, distance "D" between ropes 24 arranged on the back of mast 3 and the axis of carrying member 31 is equal to distance "D" between the axis of carrying member 31 and ropes 24 arranged on the front of mast 3, where drilling head 5 is arranged.

The use of a hoist 4, which is arranged in a fixed structure so as to move drilling head 5, allows a higher efficiency to be obtained, guaranteeing at the same time a direct and easy control over the position of drilling head 5, thus allowing loads to be distributed equally. This solution avoids an asymmetrical distribution of the forces that might generate bending moments of structure and, in particular, of carrying element 31.

Drilling rig 1 according to the present invention, thanks to a simple and functional hoist 4, allows drilling head 5 to be moved along an axis that is parallel to longitudinal axis "Z" of the mast. By combining the contribution given by the use of the hoist for the movement drilling head 5 with the presence of a carriage 51, comprising a pantograph mechanism 511, one can increase the automation of drilling rig 1, since the same drilling head 5 can be used to draw one or more drill pipes "W" from a mouse hole "P".

Said mouse hole "P" is used as an intermediate positioning point, by means of which the drill pipes move towards centre well "T" or the drill pipe store. These drill pipes are moved one at a time from and to said mouse hole "P".

In mouse hole "P", the drill pipes are preferably kept in a vertical position, so that drilling head 5, by means of pantograph mechanism 511, can extend and grasp the drill pipe positioned in mouse hole "P", so as to take it to centre well "T" and vice versa.

Mast 3 is preferably fixed to a vehicle in a reclining manner, so as to allow the drilling rig to be quickly moved among different drilling sites.

As shown for example in FIGS. 1A and 1B, the drilling rig is installed on a trailer "V2", which is towed by a vehicle "V1", for example a road tractor.

The above description has to be considered as the explanatory description of preferred embodiments of the invention. Hence, it cannot be considered as limiting.

NUMERICAL REFERENCES

Drilling rig 1
Drill floor 21

Rotary table 211
Base section 22
Stabilizer 211
Front leg 221*a*
Front shoes 212
Back shoes 213
Hoisting wire rope 24
Pulley 26
Raising cylinder 28
Mast 3
Fixed portion 30
Main load carrying member 31
Chamber 310
Sleeve 311
Piston 312
Rod 313
Gasket 314
Relief valve 315
Mobile portion 32
Hydraulic feeding system 33
Guides 35
Draw-works or Hoist 4
Shaft 41
Drums 43
Gear drive 45
Motors 47
Control unit 471
Brakes 49
Drilling head 5
Carriage 51
Pantograph mechanism 511
Hydraulic motors 55
Distance D
Mouse hole P
Center well T
BOP B
Truck V1
Trailer V2
Longitudinal axis Z

The invention claimed is:

1. A mobile drilling rig comprising a mast, drilling head, for sliding, in use, along said mast, and at least one hoist;

said drilling head is supported by at least two hoisting wire cables;

said mast is telescopic comprising a main load carrying member, for extending said mast, at an end of said mast a plurality of pulleys are provided, on which said at least two hoisting wire cables slide; comprising:

said main load carrying member is adapted to bring said mast between a closed operating configuration and working operating configuration; in said working operating configuration, said main load carrying member is locked and said mast is completely extended;

said at least two hoisting wire cables produce movement of the drilling head, when said mast is in the working operating configuration; said at least two hoisting wire cables being pulled and released by said at least one hoist;

said mast is symmetrical relative to said main load carrying member;

wherein said at least one hoist is electrically controlled with a gear drive:

at least one electric motor controlled by at least one control unit;

said drilling head comprises a carriage, said carriage comprising a pantograph mechanism for moving said drilling head along an axis that is substantially transverse to a longitudinal axis of the mast, said pantograph mechanism comprising an articulated quadrilateral comprising two rigid arms, which are fixed to the carriage and to the drilling head, and at least two pistons, each of the pistons being fixed to said carriage and to one of said arms, for moving the drilling head by roto-translation movement during movement of the pistons.

2. The drilling rig according to claim 1, wherein said at least one hoist comprises a single shaft.

3. The drilling rig according to claim 2, wherein the hoist comprises four drums, the drums being controlled by two electric motors, which are arranged at ends of the single shaft, which is shared by all the drums.

4. The drilling rig according to claim 1, wherein said carriage is configured to slide on guides, which are comprised in the mast.

5. The drilling rig according to claim 1, wherein said main load carrying member is a hydraulic cylinder comprising a sleeve, to which the mast is fixed, and a piston, including a rod connected to a hydraulic feeding system.

6. The drilling rig according to claim 1, wherein said drilling rig is mounted on a vehicle for transportation of the drilling rig.

7. The drilling rig according to claim 1, wherein the movement of the drilling head takes place only by said at least two hoisting wire cables, which are pulled and released by said at least one hoist.

* * * * *